US007529516B2

(12) United States Patent
Ishio et al.

(10) Patent No.: US 7,529,516 B2
(45) Date of Patent: May 5, 2009

(54) METHOD AND APPARATUS FOR IMAGE PROCESSING

(75) Inventors: Hisaya Ishio, Toda (JP); Katsuhiro Yoshida, Kashiwa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 255 days.

(21) Appl. No.: 11/405,740

(22) Filed: Apr. 18, 2006

(65) Prior Publication Data

US 2007/0242994 A1 Oct. 18, 2007

(51) Int. Cl.
*G03G 15/00* (2006.01)

(52) U.S. Cl. ..... 399/363; 399/377

(58) Field of Classification Search ..... 399/380, 399/379, 367

See application file for complete search history.

(56) References Cited

U.S. PATENT DOCUMENTS 6,761,080 B2 * 7/2004 Lange et al. ..... 74/89.37

FOREIGN PATENT DOCUMENTS

| | | | |
|---|---|---|---|
| JP | 5-134503 | | 5/1993 |
| JP | 06019006 | A * | 1/1994 |
| JP | 2003307787 | A * | 10/2003 |

* cited by examiner

*Primary Examiner*—Daniel J Colilla
*Assistant Examiner*—Allister Primo
(74) *Attorney, Agent, or Firm*—Amin, Turocy & Calvin, LLP

(57) ABSTRACT

An image processing apparatus according to this invention has an apparatus body containing an image forming part, an opening/closing member attached to be openable/closable about an opening/closing shaft via a hinge with respect to an upper surface of the apparatus body, a detecting part that detects an opening/closing state of the opening/closing member, a scanner part arranged in an upper part of the apparatus body and arranged to be slidable horizontally, and a driving part that slides the scanner part in accordance with the opening/closing state of the opening/closing member from the detecting part.

11 Claims, 3 Drawing Sheets

METHOD AND APPARATUS FOR IMAGE PROCESSING

BACKGROUND OF THE INVENTION

1. Field of the Invention

This invention relates to a method and apparatus for image processing in which scanner part on apparatus body side is slid in accordance with the opening/closing state of an opening/closing member provided to be openable/closable in the apparatus body.

2. Description of the Related Art

Of image processing apparatuses such as copy machines, those having an automatic manuscript feeder (opening/closing member) attached to be openable/closable by a hinge with respect to a scanner surface of a scanner part of an apparatus body are known. The automatic manuscript feeder has the function of automatically and continuously sending out plural manuscripts onto the scanner surface. At the position thereon that faces the scanner surface, a manuscript holding mechanism is formed for holding the fed plural manuscripts in tight contact with the scanner surface.

In the image processing apparatus in which such an automatic manuscript feeder is provided, a manuscript setting reference is situated on the deep side on the scanner surface. Therefore, there is a problem that an operator cannot easily set manuscript to the manuscript setting reference if the operator is a wheelchair user. There is another problem that when the automatic manuscript supply mechanism opens to approximately 90 degrees with respect to the scanner surface, the wheelchair user's hand cannot reach it and cannot open or close it easily.

On the other hand, if the maximum opening/closing angle is restricted to approximately 60 degrees, the automatic manuscript feeder is at the position suitable for the use by the wheelchair user. However, when a non-handicapped person sets manuscripts on the scanner surface of the scanner part, the scanner surface might be obstructed by the automatic manuscript feeder.

BRIEF SUMMARY OF THE INVENTION

An object of this invention is to provide a method and apparatus for image processing that enable an operator to easily set manuscripts to a manuscript setting reference on a scanner surface, irrespective of whether the operator is a non-handicapped person or a wheelchair user or the like.

This invention provides an image processing apparatus comprising:

an apparatus body containing an image forming part; an opening/closing member attached to be openable/closable about an opening/closing shaft via a hinge with respect to an upper surface of the apparatus body; a detecting part that detects an opening/closing state of the opening/closing member; a scanner part arranged in an upper part of the apparatus body and arranged to be slidable horizontally; and a driving part that slides the scanner part in accordance with the opening/closing state of the opening/closing member from the detecting part.

This invention also provides an image processing method comprising:

detecting an opening/closing state of an opening/closing member attached to be openable/closable about an opening/closing shaft via a hinge with respect to an apparatus body housing a reader; driving a scanner part horizontally and in a direction away from the hinge side in accordance with an opening/closing amount of the opening/closing member when the opening/closing member opens from a closing position to an opening position; driving the scanner part horizontally and in a direction toward the hinge side in accordance with an opening/closing amount of the opening/closing member when the opening/closing member opens from the opening position to the closing position; reading a manuscript set on the scanner part by the reader when the opening/closing member is at the closing position; and forming an image on a sheet in accordance with an image signal from the scanner part.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, an embodiment of the invention will be described with reference to the drawings.

Figure 1:
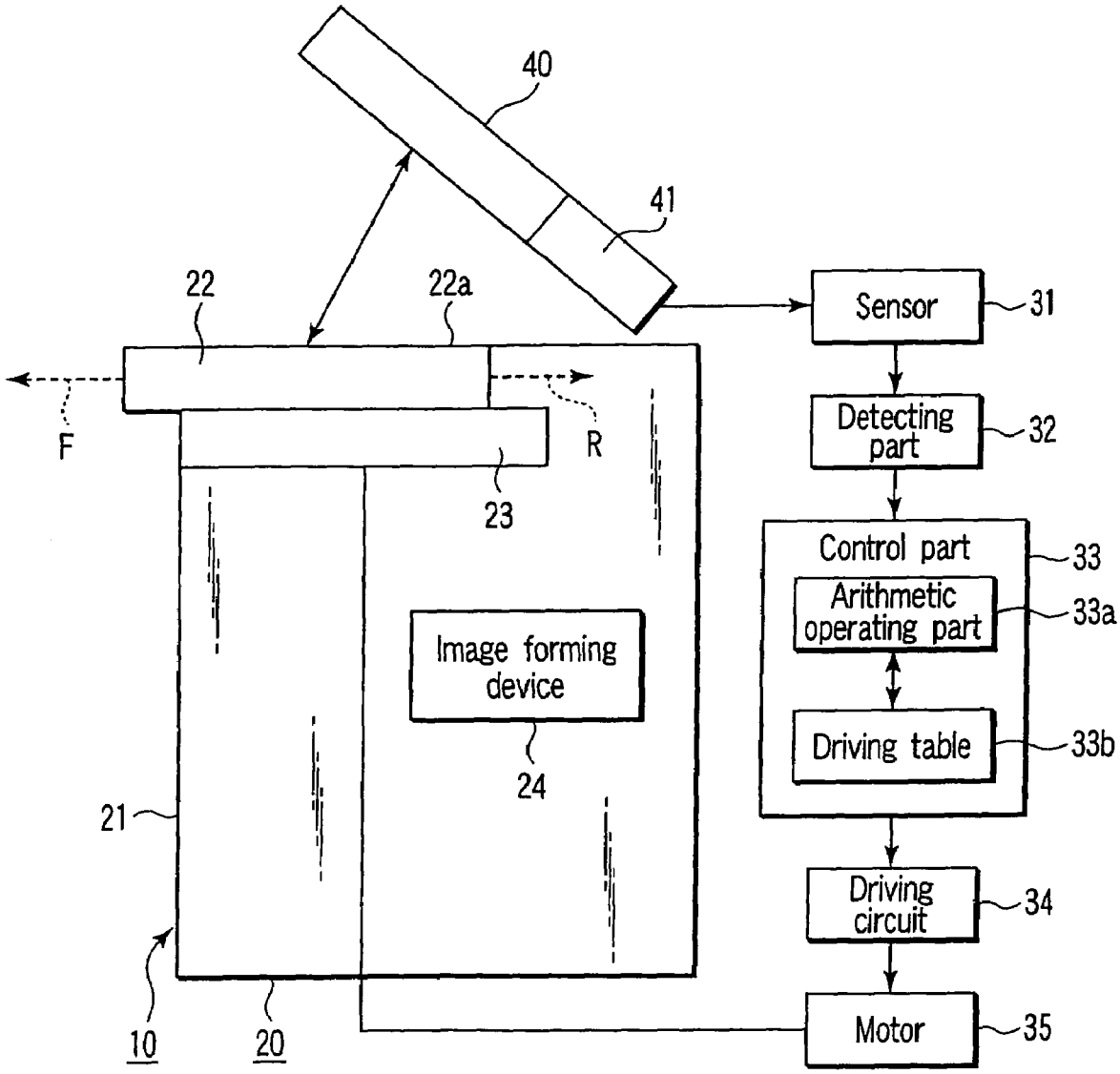
FIG. 1 is a block diagram showing a construction of an image processing apparatus to which an embodiment of this invention is applied.

FIG. 1 is a block diagram showing a construction of an image processing apparatus 10 to which an embodiment of this invention is applied. As shown in FIG. 1, the image processing apparatus 10 has an apparatus body 20, and an automatic manuscript feeder (opening/closing member) 40 provided to be openable/closable with respect to this apparatus body 20.

The apparatus body 20 has a casing 21, a scanner part 22 that is provided in an upper part of the casing 21 and reads image information of a manuscript as brightness of light, a transmission mechanism 23 that moves this scanner part 22 horizontally and in the back-and-forth directions of the casing 21, and an image forming device 24 that is housed in the casing 21 and that processes the image information read by the scanner part 22 and forms the image information on a sheet. The moving direction of the scanner part 22 is set in a direction away from a hinge part 41, which will be described later, (direction F in FIGS. 1 and 3), and a direction toward the hinge part (direction R in FIGS. 1 and 3). In FIG. 1, 22*a* represents a platen glass and 22*b* represents a scanner surface.

Moreover, there is provided a sensor 31 that detects the opening/closing angle position of the automatic manuscript feeder 40 and the position of the scanner part 22, a detecting part 32 that calculates the opening/closing angle position of the automatic manuscript feeder 40 and the position of the scanner part 22 from output values of this sensor 31, a control part 33 that outputs a driving signal based on the opening/closing angle position and the position from this detecting part 32, a driving circuit 34 that outputs driving power based on the driving signal from this control part 33, and a rotary motor 35 driven a predetermined number of rotations and for a predetermined rotation time by the inputted driving power.

An arithmetic operating part 33*a* and a driving table 33*b* are provided in the control part 33. The rotation force of the motor 35 is converted to reciprocating motion by the transmission mechanism 23 and transmitted to the scanner part 22.

The automatic manuscript feeder 40 is supported to be openable/closable about an opening/closing shaft via the hinge part (hinge) 41 with respect to the casing 21. The hinge part 41 can support the automatic manuscript feeder 40 so that it can freely open and close between a closing position (opening/closing angle position of 0 degree) and an opening position (opening/closing angle position of 60 degrees).

Figure 2:
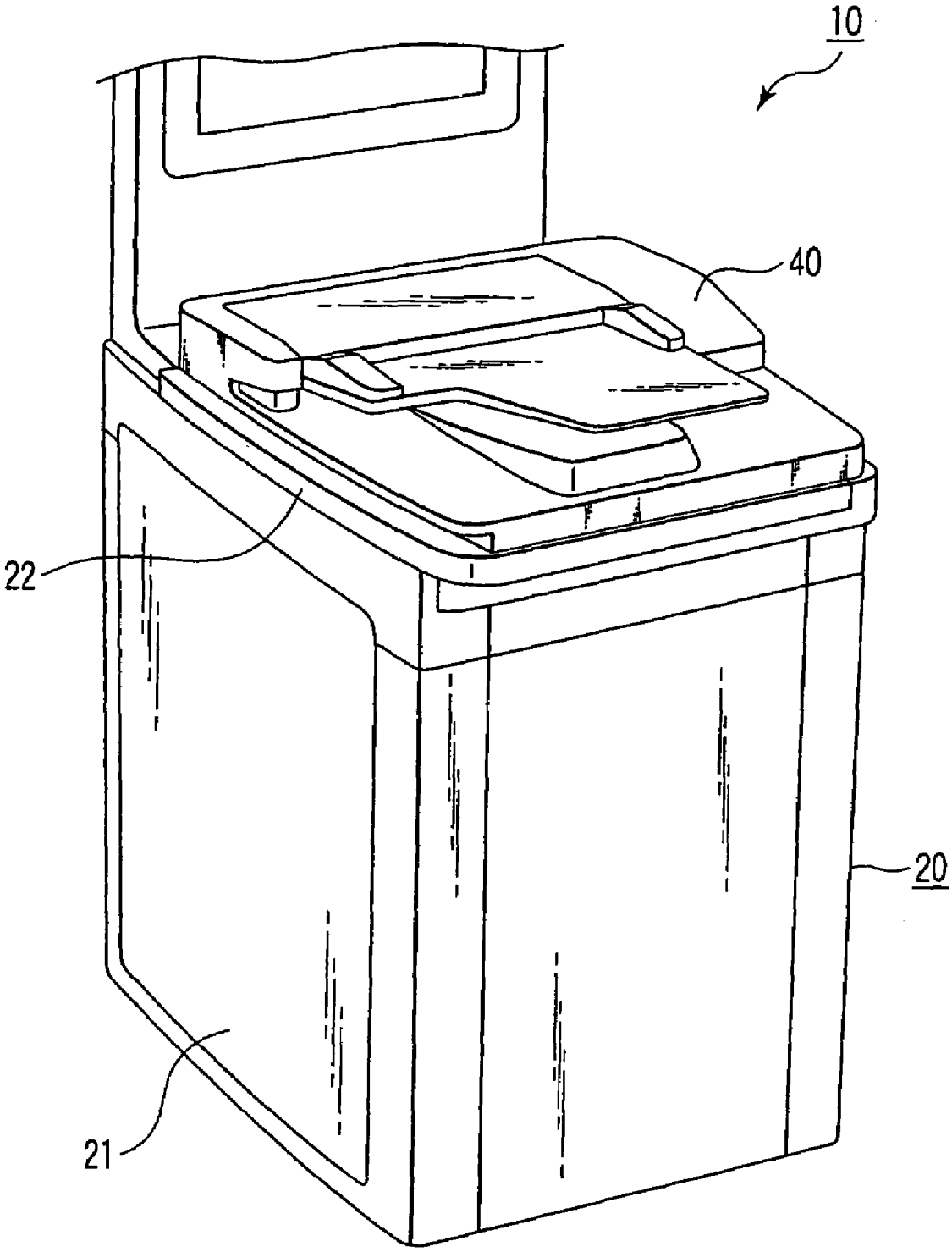
FIG. 2 is a perspective view showing a state where an opening/closing member is closed in the image processing apparatus.

The image processing apparatus 10 constructed as described above is used in the following manner. That is, in standby state, the automatic manuscript feeder 40 is at the closing position as shown in FIG. 2, and the scanner part 22 is situated on the side that is nearest to the hinge part 41. At this point, the automatic manuscript feeder 40 and the scanner part 22 are in a positional relation of facing each other.

First, a case of copying using the automatic manuscript feeder 40 will be described. Manuscripts are set on the automatic manuscript feeder 40 in the closing position, and copying is started. The manuscripts are automatically and continuously sent onto the scanner surface 22*b* of the scanner part 22 by the automatic manuscript feeder 40. The image information of the manuscripts is read by the scanner part 22 and an image is formed on a sheet-by the image forming device 24.

Next, a case of copying without using the automatic manuscript feeder 40 will be described. To set manuscripts on the scanner surface 22*a*, the automatic manuscript feeder 40 needs to be opened. Therefore, the automatic manuscript feeder 40 is opened from the closing position to an opening/closing angle position of 30 degrees. In this section, the scanner part 22 does not move.

As the automatic manuscript feeder 40 has reached the opening/closing angle position of 30 degrees, the opening/closing angle position is calculated by the detecting circuit 32 via the sensor 31 and this opening/closing angle position is inputted to the control part 33. In the control part 33, the opening/closing angle position is compared with the position of the scanner part 22 by the driving table 33*b* and the amount of movement to a predetermined position is calculated by the arithmetic operating part 33*a*. This required amount of movement is transmitted to the driving circuit 34, and the driving circuit 34 drives the motor 35 for a required rotation time.

Figure 3:
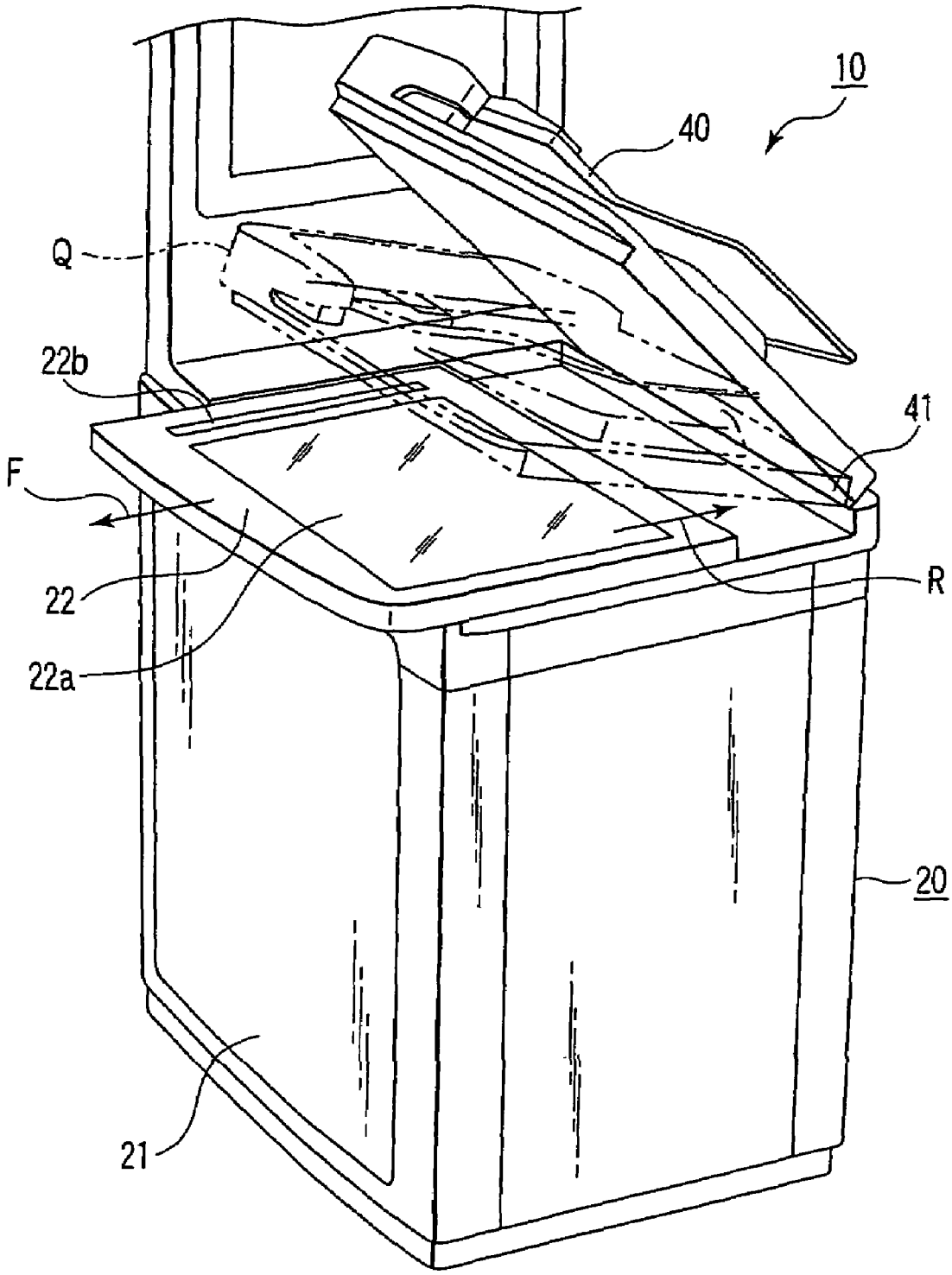
FIG. 3 is a perspective view showing a state where the opening/closing member is opened.

In this manner, the scanner part 22 moves in direction F in FIG. 3, interlocked with the opening/closing angle position of the automatic manuscript feeder 40, until the opening/closing angle position of the automatic manuscript feeder 40 reaches 45 degrees. In FIG. 3, a double-dotted chain line Q represents when the opening/closing angle position of the automatic manuscript feeder 40 is 45 degrees.

As the opening/closing angle position of the automatic manuscript feeder 40 has reached 45 degrees, the scanner part 22 reaches a maximum movement position and stops. Therefore, from the opening/closing angle position of 45 degrees to the opening/closing angle position of 60 degrees of the automatic manuscript feeder 40, the scanner part 22 does not operate. Then, as the opening/closing angle position of the automatic manuscript feeder 40 has reached 60 degrees, the automatic manuscript feeder 40 stops because of the regulation by the hinge part 41.

From the opening/closing angle position of 45 degrees to the opening/closing angle position of 60 degrees of the automatic manuscript feeder 40, since the scanner surface 22*a* of the scanner part 22 is protruding forward, the operator can easily align the manuscripts to a manuscript setting reference situated on the scanner surface 22*a*.

Next, as the automatic manuscript feeder 40 is getting closed, the rotation angle position of the automatic manuscript feeder 40 and the position of the scanner part 22 are inputted to the control part 33, and the scanner part 22 moves to a predetermined position as in the case of opening.

Specifically, from the opening/closing angle position of 45 degrees to the opening/closing angle position of 60 degrees of the automatic manuscript feeder 40, the scanner part 22 does not operate. As the opening/closing angle position of the automatic manuscript feeder 40 has reached 45 degrees, the scanner part 22 starts moving in direction R in FIGS. 1 and 3 from the maximum movement position. In this manner, the scanner part 22 moves in direction R in FIG. 3, interlocked with the opening/closing angle position of the automatic manuscript feeder 40, until the opening/closing angle position of the automatic manuscript feeder 40 reaches 30 degrees.

As the opening/closing angle position of the automatic manuscript feeder 40 has reached 35 degrees, the scanner part 22 reaches the original position and stops. Therefore, from the opening/closing angle position of 30 degrees to the opening/closing angle position of 0 degree of the automatic manuscript feeder 40, the scanner part 22 does not operate.

When copying is started in this state, image information of the manuscripts is read from the scanner part 22 and an image is formed onto a sheet by the image forming device 24.

In this manner, with the image processing apparatus 10 according to an embodiment of this invention, since the opening/closing angle position of the automatic manuscript feeder 40 is limited to 60 degrees, the operator's hand can easily reach the automatic manuscript feeder 40 even if the operator is a wheelchair user or the like, and the automatic manuscript feeder 40 does not obstruct the scanner surface 22*a* if the operator is a non-handicapped person, thus causing no trouble in the use. Therefore, the operator can easily set manuscripts to the manuscript setting reference on the scanner surface, irrespective of whether the operator is a non-handicapped person or a wheelchair user or the like.

Also, since the maximum opening/closing angle position of the automatic manuscript feeder 40 is 60 degrees, the total height of the image processing apparatus 10 can be limited, and even if a paper discharge unit is in an upper part of the apparatus body 20, it does not interfere with the automatic manuscript feeder 40.

In the control part 33 and the driving circuit 34, the method of moving the scanner part 22 can be set in various manners according to the need. For example, the opening/closing angle positions where the scanner part 22 starts and stops moving, and the rotation speed or the like of the motor 35 may be properly changed. Also, if an upper limit speed of the rotation speed of the motor 35 is set or the rotation speed is set to be constant by the driving circuit 34, even when the automatic manuscript feeder 40 opens and closes quickly, the scanner part 22 can be prevented from sliding correspondingly fast. Thus, contact of the scanner part 22 with the operator and deviation of manuscripts from the manuscript setting reference on the scanner surface 22*a* can be prevented. Also, copying may be started after it is confirmed by the sensor 31 that the scanner part 22 has been returned to the original position.

As for the scanner part 22, the entire construction including an optical system is formed as a single unit, and the scanner part 22 can read manuscripts even if it is pulled out. For example, when copying a thick book, the automatic manuscript feeder 40 cannot be closed to the opening/closing angle position of 30 degrees, but the image information of the manuscript can be read even if the automatic manuscript feeder 40 is, for example, at the opening/closing angle position of 45 degrees.

In addition, the sliding movement of the scanner part 22 can be arbitrarily canceled.

The image processing apparatus according to this invention includes a printer, facsimile and the like, other than a copy machine. Therefore, the image processing apparatus is not limited to a copy machine.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image processing apparatus comprising:

an apparatus body containing an image forming part:

an opening/closing member attached to be openable/closable about an opening/closing shaft via a hinge with respect to an upper surface of the apparatus body;

a detecting part that detects an opening/closing state of the opening/closing member;

a scanner part arranged in an upper part of the apparatus body and arranged to be slidable horizontally; and a driving part that slides the scanner part in accordance with the opening/closing state of the opening/closing member from the detecting part, wherein in a case of opening the opening/closing member from the scanner part, the driving part slides the scanner part in a direction away from the hinge.

2. The image processing apparatus according to claim 1, wherein the driving part positions the scanner part at a position facing the opening/closing member when the opening/closing member is at a closing position.

3. The image processing apparatus according to claim 2, wherein in a case of opening the opening/closing member from the closing position to an opening position, the driving part starts sliding the scanner part at a time point when the opening/closing member has been opened to a predetermined opening angle.

4. The image processing apparatus according to claim 2, wherein in a case of opening the opening/closing member from an opening position to the closing position, the driving part completes sliding the scanner part at a time point when the opening/closing member has been closed to a predetermined closing position.

5. The image processing apparatus according to claim 1, wherein the driving part drives the scanner part at a constant moving speed.

6. An image processing method comprising:

detecting an opening/closing state of an opening/closing member attached to be openable/closable about an opening/closing shaft via a hinge with respect to an apparatus body housing a reader;

driving a scanner part horizontally and in a direction away from the hinge side in accordance with an opening/closing amount of the opening/closing member when the opening/closing member opens from a closing position to an opening position;

driving the scanner part horizontally and in a direction toward the hinge side in accordance with an opening/closing amount of the opening/closing member when the opening/closing member opens from the opening position to the closing position;

reading a manuscript set on the scanner part by the reader when the opening/closing member is at the closing position; and forming an image on a sheet in accordance with an image signal from the scanner part.

7. An image processing method comprising:

detecting an opening/closing state of an opening/closing member attached to be openable/closable about an opening/closing shaft via a hinge with respect to an upper surface of an apparatus body comprising an image forming part;

sliding a scanner part arranged in an upper part of the apparatus body and arranged to be slidable horizontally in accordance with the opening/closing state of the opening/closing member; and sliding the scanner part in a direction away from the hinge in a case of opening an opening/closing part from a scanner part.

8. The image processing method according to claim 7, wherein the scanner part is positioned at a position facing the opening/closing member when the opening/closing member is at a closing position.

9. The image processing method according to claim 8, wherein in a case of opening the opening/closing member from the closing position to an opening position, the scanner part starts sliding at a time point when the opening/closing member has been opened to a predetermined opening angle.

10. The image processing method according to claim 8, wherein in a case of opening the opening/closing member from an opening position to the closing position, the scanner part completes sliding at a time point when the opening/closing member has been closed to a predetermined closing position.

11. The image processing method according to claim 7, wherein the scanner part is driven at a constant moving speed when the scanner part moves.

* * * * *